US008177355B2

(12) United States Patent
Toya

(10) Patent No.: US 8,177,355 B2
(45) Date of Patent: May 15, 2012

(54) RECORDING APPARATUS

(75) Inventor: Akihiro Toya, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 211 days.

(21) Appl. No.: 12/765,238

(22) Filed: Apr. 22, 2010

(65) Prior Publication Data

US 2010/0271452 A1 Oct. 28, 2010

(30) Foreign Application Priority Data

Apr. 23, 2009 (JP) ..... 2009-105020
Jan. 12, 2010 (JP) ..... 2010-003845

(51) Int. Cl.
*B41J 2/01* (2006.01)

(52) U.S. Cl. ..... 347/104

(58) Field of Classification Search ..... None
See application file for complete search history.

(56) References Cited

U.S. PATENT DOCUMENTS 6,270,215 B1 8/2001 Miyasaka et al.

FOREIGN PATENT DOCUMENTS

JP 11-208045 8/1999
JP 2005-059400 3/2005
JP 2009-029020 2/2009

*Primary Examiner* — Stephen Meier
*Assistant Examiner* — Tracey McMillion
(74) *Attorney, Agent, or Firm* — Workman Nydegger

(57) ABSTRACT

A recording apparatus includes: a recording head that executes recording by ejecting ink onto a recording surface of a recording material; a platen that supports a face opposite the recording surface of the recording material positioned on a recording execution region by the recording head; and a plurality of suction hole sections provided in the platen. The platen is configured so that both side edge sections in a width direction provided with the suction hole sections are retractable with respect to the recording head, and both side edge sections of the platen are advanced towards the recording head and are retracted after attaching by suction of a curling section of the right and left side edges of the recording material and then after retraction, recording is executed on the recording material by the recording head.

3 Claims, 8 Drawing Sheets

RECORDING APPARATUS

BACKGROUND

1. Technical Field

The present invention relates to a recording apparatus that corrects warpage in a recording material to whereby execute recording in a flat surface.

2. Related Art

A recording apparatus such as an ink jet printer may include a heater provided with respect to a platen that supports a recording material and regulates a gap with a recording head to whereby promote drying of ink ejected on to the recording face of the recording material. This type of recording apparatus provided with a platen having a heater may cause warpage (hereinafter also referred to as "curl") in the recording material due to heat transmitted via the platen. Such warpage is characterized by protruding warpage in which a central transverse section of the recording material becomes higher, and indented warpage in which the edge section of both transverse ends of the recorded material become higher.

A recording apparatus provided with an air suction device as described in JP-A-11-208045 has been proposed to correct warpage in the recording material. The recording apparatus forms a plurality of suction holes in an upstream section of the platen in a recording execution region and uses a suction force produced by the suction device provided in an inner section of the platen to place the recording material in close contact with the upper surface of the platen.

However the recording apparatus disclosed in JP-A-11-208045 has the object of preventing the recording material P which has a pre-existing curl as a result of humidity or the like from being floated by suction to the upper surface of the platen. Thus there is no effect in which the overall surface of the recording material is re-attached to an upper surface of the platen by correcting curl resulting from heat during drying on a platen.

In particular, with respect to a recording material that produces indented warpage as described above, since a suction force is not effectively applied to an edge section of recording material that produces warpage, head wear or adverse effects on recording quality are caused due to insufficient correction of warpage.

SUMMARY

An advantage of some aspects of the invention is to provide a recording apparatus, in light of the above technical background, for executing recording on a recording surface of a recording material in which the warpage produced in the recording material is corrected.

According to an aspect of the invention, a recording apparatus includes a recording head that executes recording by ejecting ink onto a recording surface of a recording material, a platen that supports a face opposite the recording surface of the recording material positioned on a recording execution region by the recording head, and a plurality of suction hole sections provided in the platen. Both side edge sections in the width direction of the platen are retractable with respect to the recording head.

According to this aspect, both side edge sections of the platen are advanced towards the recording head to place an opening of the suction hole sections in proximity to a curl section of both sides of the recording material which is separated from the platen surface by the curl. Then the warpage in the recording material is flattened by retreating both side edge sections of the platen with the curl section of the recording material attached by suction to the suction hole section. In this manner, high-quality recording can be executed without an effect of curl on the recording surface.

The effect of this aspect can be obtained irrespective of whether the curl is produced before the recording material is supported on the platen or after being supported on the platen.

According to another aspect of the invention, both side edge sections in the recording apparatus according to the other aspect form an integrated movable unit with a unit including the plurality of suction hole sections.

According to this aspect, since both side edge sections form an integrated movable unit with a unit including the plurality of suction hole sections, the plurality of suction hole sections provided along the curl section of the recording material are advanced at the same time to enable contact and attachment by suction of the openings of each suction hole section with the curl section. After attachment by suction, if the plurality of suction hole sections are retracted at the same time, warpage produced in the recording material can be corrected at once along the entire printing execution region present on the platen.

According to another aspect of the invention, the movable units of other aspects of the recording apparatus are provided in at least two rows respectively on both sides.

According to this aspect, the inner row of the movable units is firstly used with respect to the recording material to whereby execute a first-stage correction on a section of curl in the recording material, then the outer row of movable units is used on the recording material corrected by the first-stage correction to whereby execute a second-stage correction on the curl section and whereby correct warpage and flatten the recording material. Thus correction of warpage in the recording material is ensured by the two-stage correction operation.

According to another aspect of the invention, the retractable suction hole section on both side edge sections in a recording apparatus according to any one of other aspects includes a suction face facing the recording material that is formed as a sloping face along the curled shape of the recording material.

According to this aspect, the suction face of the suction hole section can be placed in proximity to the recording material by facing the section in which curl is produced in the recording material. Thus correction of warpage in the recording material is ensured by application of the suction face of the suction hole section to the section producing curl in the recording material.

According to another aspect of the invention, the angle of inclination of the suction face of the recording apparatus according to the above mentioned aspect is switched in at least two stages.

According to this aspect, the angle of inclination of the suction face of the suction hole section can be switched to a more suitable angle in response to the dimension of the curl in the recording material. Thus the suction force of the suction hole section with respect to the section producing curl in the recording material is increased to whereby enable more accurate correction of warpage in the recording material.

According to another aspect of the invention, both retractable side edge sections of the recording apparatus according to any one of other aspects are provided through a resilient member that is biased to project towards the recording material with a force which is smaller than the suction force of the suction hole section.

According to this aspect, both retractable side edge sections are provided through a resilient member that is biased to project towards the recording material with a force which is smaller than the suction force of the suction hole section.

Thus the suction face of the suction hole section can be placed in proximity to the recording material by the biasing force of the resilient member even when a separate motive force is not provided to advance the suction hole section towards the recording head. Thus the suction hole section can be retracted together with the curl section of the recording material by a suction force such as an induced draft fan.

According to another aspect of the invention, both retractable side edge sections of the recording apparatus according to any one of other aspects are provided in a plurality of positions corresponding to the assumed dimensions of the recording material to be used.

According to this aspect, since the movable suction hole section to be used can be selected according to differences in the dimensions of the recording material, correction of warpage produced in the recording material can be ensured without regard to differences in the dimensions of the recording material.

BRIEF DESCRIPTION OF THE DRAWINGS

The invention will be described with reference to the accompanying drawings, wherein like numbers reference like elements.

DESCRIPTION OF EXEMPLARY EMBODIMENTS

The structure and operational aspects of the recording apparatus according to the invention will be described hereafter. An ink jet printer 1 firstly is used as an example of the recording apparatus according to the invention and the ink jet printer 1 is shown schematically in FIG. 1 and FIG. 2.

The ink jet printer 1 shown in the figures is an ink jet printer having a structure in which recording is executed with respect to a long film-like or paper recording material P. The recording material P includes roll paper R as shown in FIG. 1 or cut paper P shown in FIG. 2 as an applicable one (designated by the same reference symbol P as the recording material P).

Figure 1:
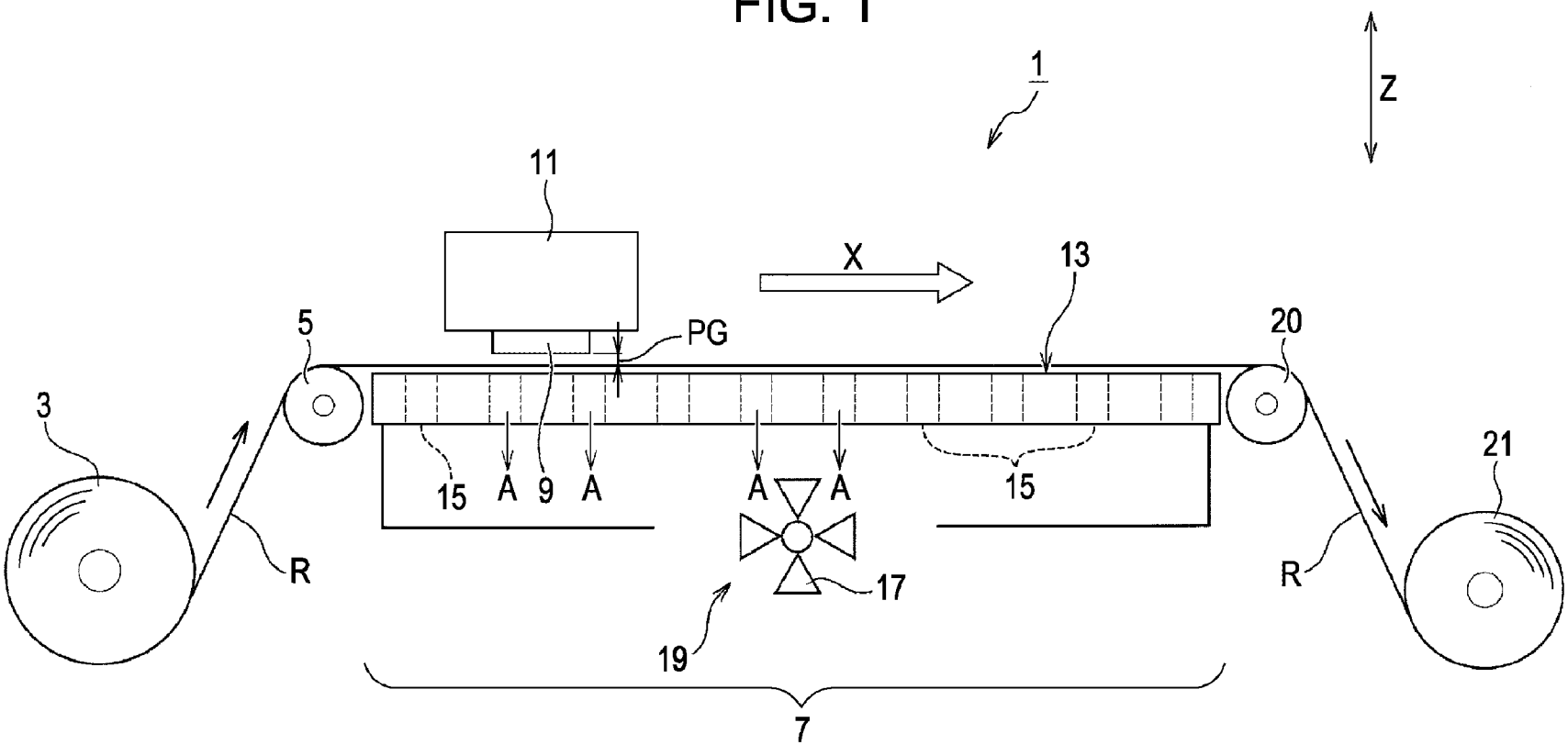
FIG. 1 is a schematic side view showing the internal structure of an ink jet printer according to a first embodiment of the invention.
Figure 2:
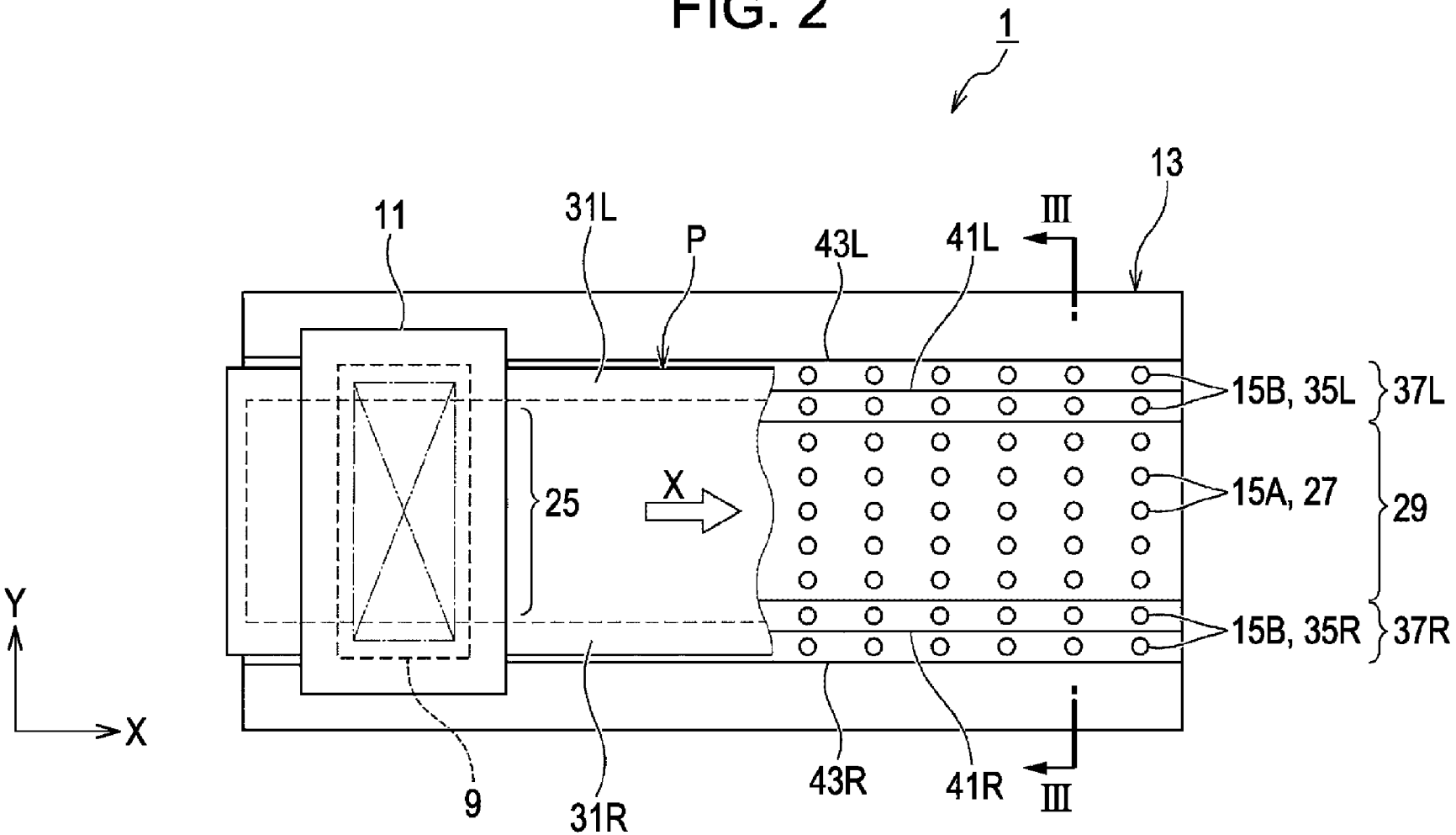
FIG. 2 is a plan view showing the peripheral section to the recording execution region of the ink jet printer according to the first embodiment of the invention.
Figure 3:
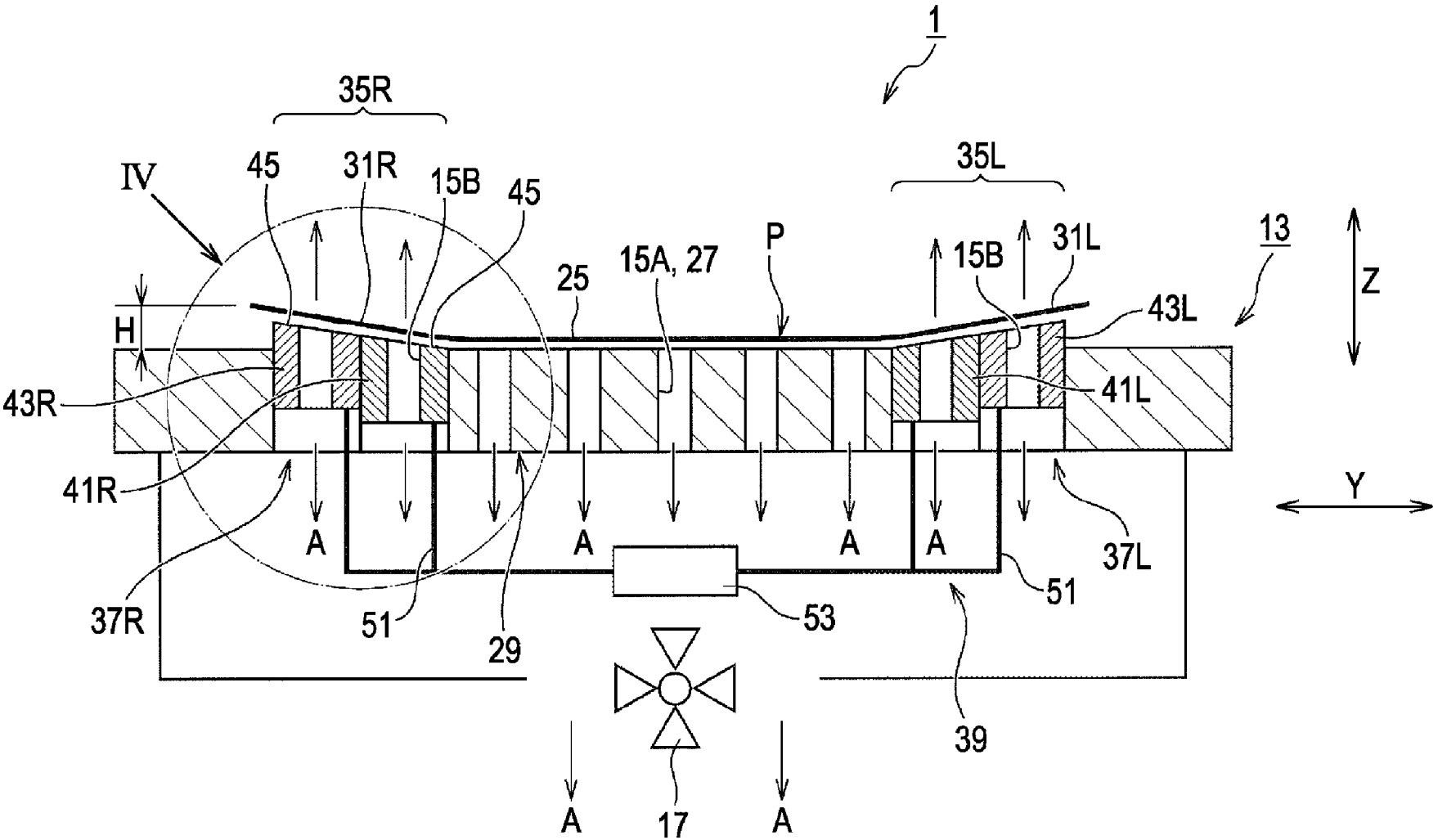
FIG. 3 is a sectional view along the line III-III in FIG. 2 according to the first embodiment of the invention.

In FIG. 1 and FIG. 2, the left end side is an upstream direction with respect to the transport direction X of the recording material P (hereinafter simply the "upstream side") and the right end side is a downstream direction with respect to the transport direction X of the recording material P (hereinafter simply the "downstream side"). A feed section 3 for the roll paper R is provided on the upstream side as shown in FIG. 1 and the roll paper R that is fed from the feed section 3 is guided to a transport guide roller 5 and introduced to a recording execution region 7 that is elongated in the transport direction X.

A recording head 9 that executes recording by ejection of ink of various colors onto an upper face which is the recording surface of the recording material P is provided on the recording execution region 7. The recording head 9 is retained by a carriage 11 which reciprocates in the transport direction X and moves across the entire surface of the recording execution region 7 that is elongated in a transport direction X integrally with the carriage 11.

A platen 13 is provided below the recording execution region 7 and regulates a gap PG (for example on the level of 1 mm) with the recording head 9 by supporting the lower face of the recording material P which has reached the recording execution region 7. The platen 13 includes a plurality of suction holes 15, 15 and so on and, in one example, includes a suction mechanism 19 that has a structure in which the recording material P on the platen 13 is attached by suction to an upper face of the platen 13 by a suction force A produced by an induced draft fan 17.

A discharge guide roller 20 is provided downstream of the recording execution region 7. The recording material P after recording is guided into the discharge guide roller 20. When the recording material P is cut paper P, the recording material P is discharged towards a discharge unit (not shown) and when the recording material P is roll paper R, it is rolled onto a roll section 21 as shown in the figures or cut into a predetermined length and discharged.

Next the detailed structure of a recording apparatus according to the invention will be described using five embodiments which have partially different structural elements and focusing on the configuration of the platen 13 forming the characteristic configuration of the invention as applied to an ink jet printer 1 configured as described above.

Embodiment 1

An ink jet printer 1 which is a recording apparatus according to a first embodiment as shown in FIG. 1 to FIG. 4B is disclosed. In this embodiment, the platen 13 includes a fixed platen section 29 which has a fixed suction section 27 that applies suction to a central section 25 of the recording material P on the platen 13, and platen side edge sections 37L, 37R which are movable platen sections provided with movable suction sections 35L, 35R that move in a vertical direction Z and which enable application of suction to the right and left curl sections (recording material side edge sections) 31R, 31L on the recording material P on the platen 13.

The fixed suction section 27 is configured by formation of a plurality of suction holes 15A, 15A and so on, on the flat fixed platen section 29. The right and left movable suction sections 35R, 35L are configured by formation of a plurality of suction holes 15B, 15B and so on, on the square bar-shaped right and left movable platen sections 37R, 37L. The movable platen sections 37L, 37R are configured as a movable unit forming an integrated unit of the plurality of suction holes 15B, 15B and so on. The movable units (movable platen sections) 37L, 37R are configured to be displaced vertically by a driving mechanism 39.

The driving mechanism 39 is configured by a connection arm 51 that connects the right and left movable platen sections 37R, 37L and a raising mechanism 53 that communicates motive force to the connection arm 51 to whereby vertically displace the right and left movable platen sections 37R, 37L. Although it is not shown in the figures, various mechanisms may be adopted as the raising mechanism 53 to convert the rotation of the raising motor to vertical displacement Z by using a linking mechanism, a cam mechanism or a rack and pinion mechanism or the like.

Although not shown in the figures, a configuration may be adopted in which the movable platen sections 37L, 37R are fixed and only the section of the plurality of suction holes 15B, 15B and so on is displaced vertically in an integral manner by the driving mechanism 39.

The displacement stroke in a vertical direction Z of the movable suction section 35 produced by the drive mechanism 39 is set for example to approximately 10 mm which corresponds to the maximum height H assumed for the section producing a curl in the recording material P.

In the present embodiment, the right and left movable platen sections 37R, 37L are provided respectively in two rows. The two rows of movable platen sections may be discriminated into a left movable platen section 37L in which the section positioned on an inner side is a movable platen section 41L and the section on an outer section is an movable platen section 43L, and a right movable platen section 37R in which the section positioned on an inner side is a movable platen section 41R and the section positioned on an outer section is an movable platen section 43R.

The suction face 45 of the right and left movable suction sections 35R, 35L (in this embodiment, the entire upper face of the right and left movable platen sections 37R, 37L) is configured as a sloping face along the curling shape of the recording material P to whereby improve a suction force by facing the suction face 45 opposite a section that is forming the curl of the recording material P.

In addition, although this is not shown in the figures, the movable suction sections 35L, 35R are preferably provided in a plurality of positions corresponding to the dimensions of the assumed recording material P to be used. Thus this configuration enables accurate correction of warpage in the recording material P by application of movable suction sections 35L, 35R to an optimal position even when the dimensions of the recording material P change.

Next an operating example of a recording apparatus 1 according to a first embodiment configured in the above manner will be described making reference to FIGS. 4A and 4B.

Figure 4A:
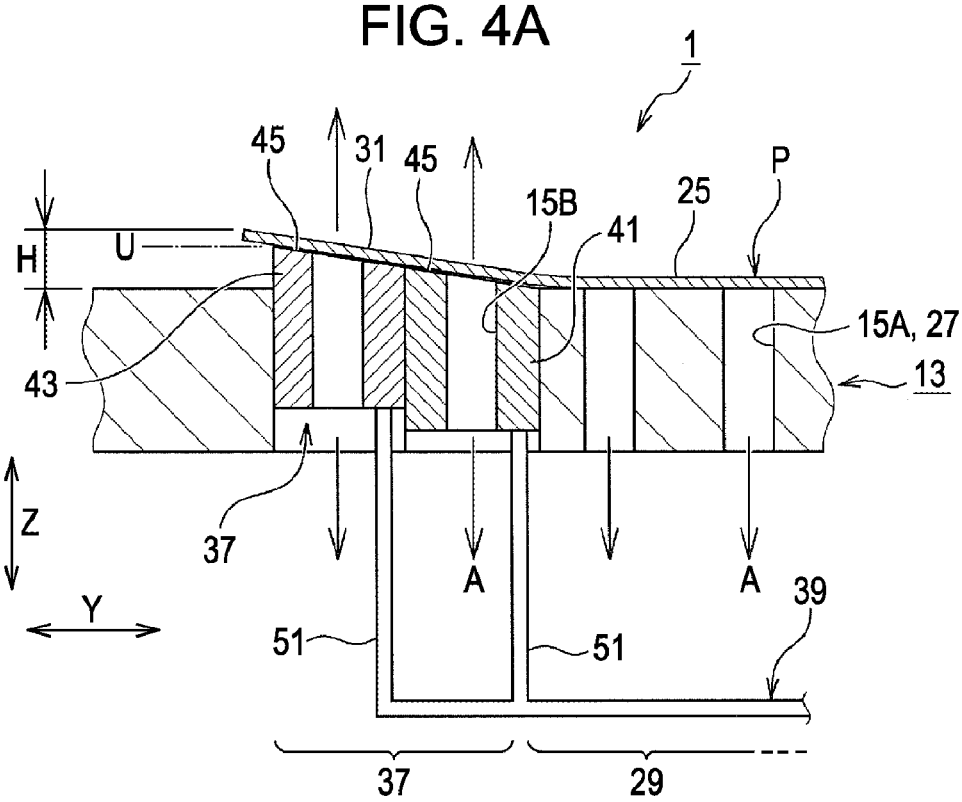
FIG. 4A is an enlarged view of section IV in FIG. 3 when the movable suction section according to the first embodiment of the invention is positioned in an upper position.

When the recording material P reaches the recording execution region 7, the driving mechanism 39 is activated as shown in FIG. 4A to displace the movable suction section 35 upwardly. The upward motion of the movable suction section 35 is stopped and suction operations are commenced by application of a suction force A produced by the induced draft fan 17 when the suction face 45 of the movable suction section 35 abuts on the recording material P or when it reaches an upper position U which is in sufficient proximity to the recording material P.

When the operation of the induced draft fan 17 is commenced, the central section 25 of the recording material P is sucked onto the upper surface of the fixed platen section 29 and the right and left curl sections (side edge sections of the recording material) 31R, 31L of the recording material P are sucked onto an upper surface of the right and left movable platen section 37R, 37L. Thus the maximum height H of the outer section of the curl section 31 of the recording material P is slightly reduced by the initial suction of the inner section of the curl section 31 of the recording material P from the inner movable platen section 41 and consequently, the angle of inclination is also reduced. Then the outer section of the curl section 31 on the recording material P which tends easily to attach to the outer movable platen section 43 becomes attached.

Figure 4B:
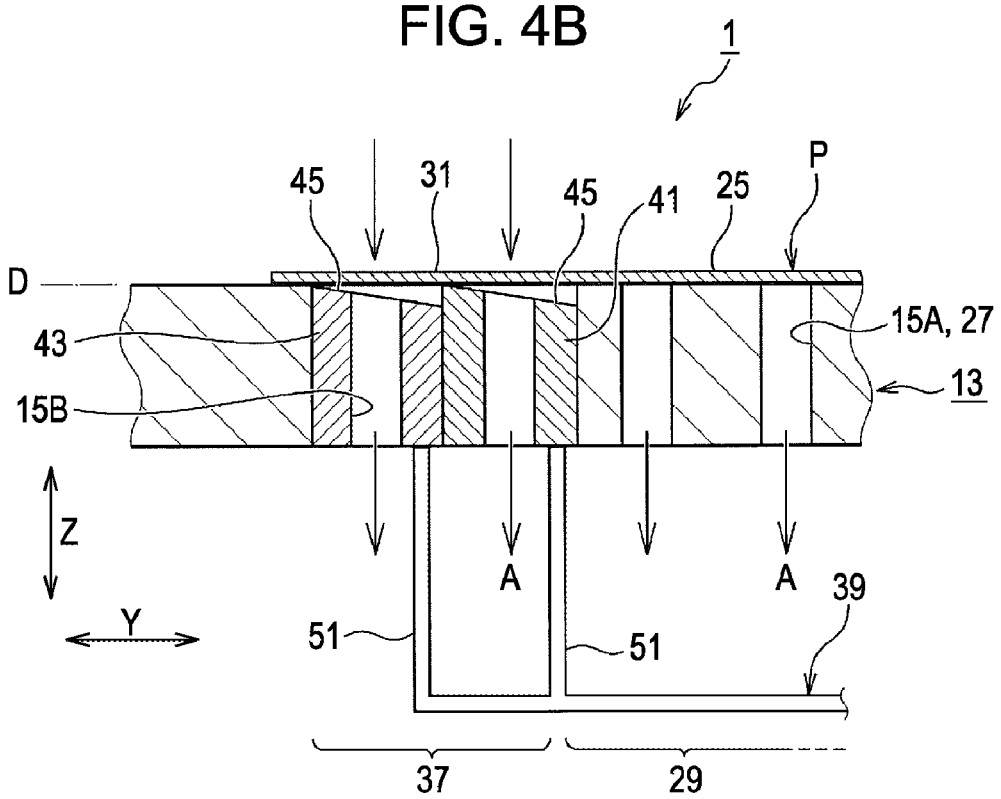
FIG. 4B is an enlarged view of section IV in FIG. 3 when positioned in a lower position.

Then the drive mechanism 39 switches the direction of operation and displaces the inner movable platen section 41 and the outer movable platen section 43 downwardly as shown in FIG. 4B. The execution of recording operations is commenced when the recording material P is flat as shown in the figure and the upper surface of the four right and left, inner and outer movable platen sections 41R, 41L, 43R, 43L has reached a lower position D which corresponds with, or is lower than the upper face of the fixed platen section 29.

Embodiment 2

Figure 5A:
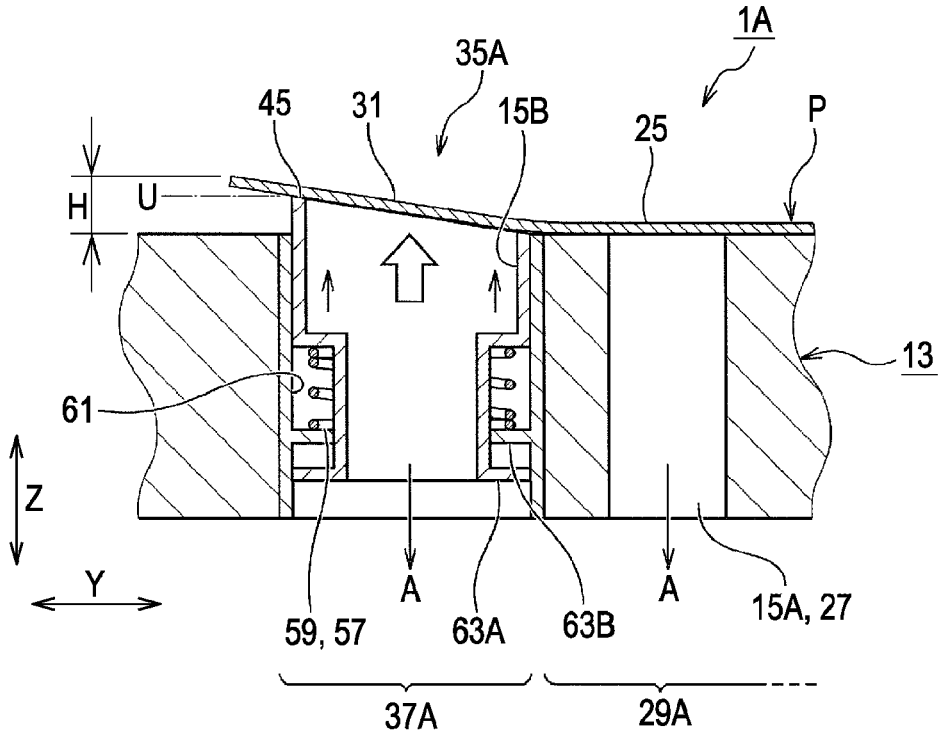
FIG. 5A is an enlarged sectional view of section IV when the movable suction section according to a second embodiment of the invention is positioned in an upper position.
Figure 5B:
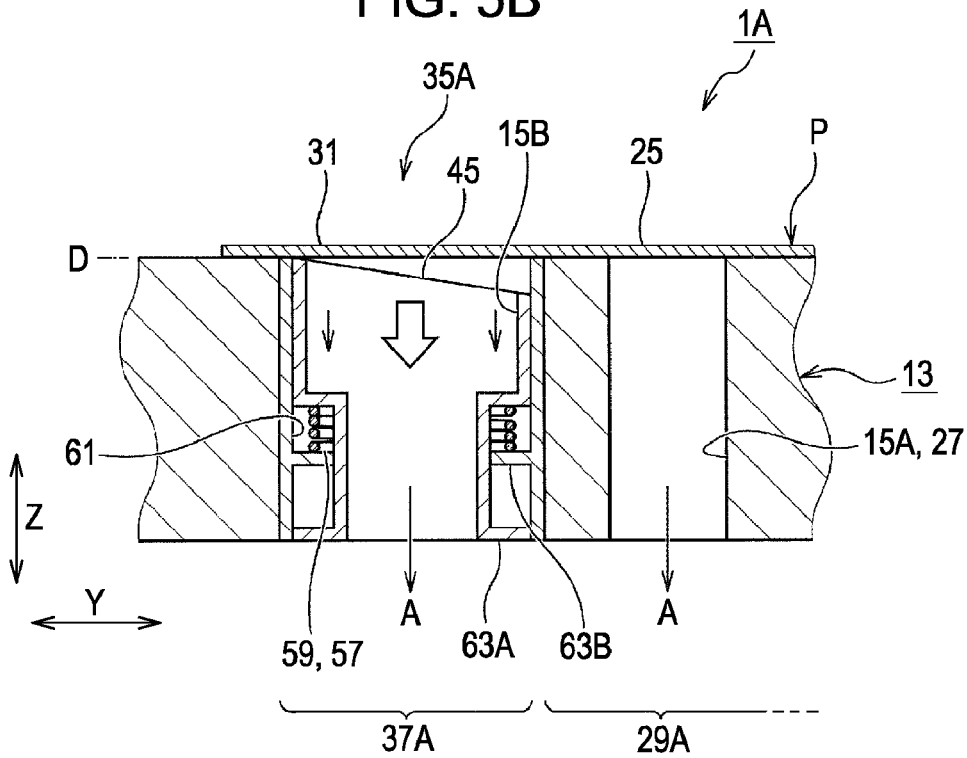
FIG. 5B is an enlarged sectional view when positioned in a lower position.

FIGS. 5A and 5B disclose the structure of the periphery of the movable platen section 37 of the ink jet printer 1A which is a recording apparatus according to a second embodiment. The basic configuration of the ink jet printer 1A is the same as that of the ink jet printer 1 according to the first embodiment and therefore only differences from the first embodiment will be described.

In this embodiment, a movable suction section 35A is provided via a resilient member 57 that is biased to project towards an upper side where the recording material P is located. Furthermore since the resilient member 57 has some or all of the functions of the drive mechanism 39, a section of the connection arm 51 or the raising mechanism 53 or both these components may be omitted. Furthermore the movable suction section 35A may be provided as a single row on the right and the left in this embodiment.

More specifically, the movable suction section 35A which normally has a projecting configuration is constructed by forming a spring space 61 containing a compressed coil spring 59 which is an example of the resilient member 57 between the movable platen section 37 and the fixed platen section 29 and a pair of detachment prevention portions 63A, 63B. The biasing force of the compressed coil spring 59 is fixed to be relatively weak so that when compressed by a load corresponding to the weight of the recording material P, the movable suction section 35A at the upper position U reaches the lower position D.

When using the ink jet printer 1A having the above configuration, the movable suction section 35A obtains the same operational effect as the first embodiment and high quality recording can be executed after correcting warpage so that the recording material P is in a flat orientation. Furthermore this embodiment separately obtains an effect by omitting the driving mechanism 39 or simplifying the structure of the driving mechanism 39.

Embodiment 3

Figure 6A:
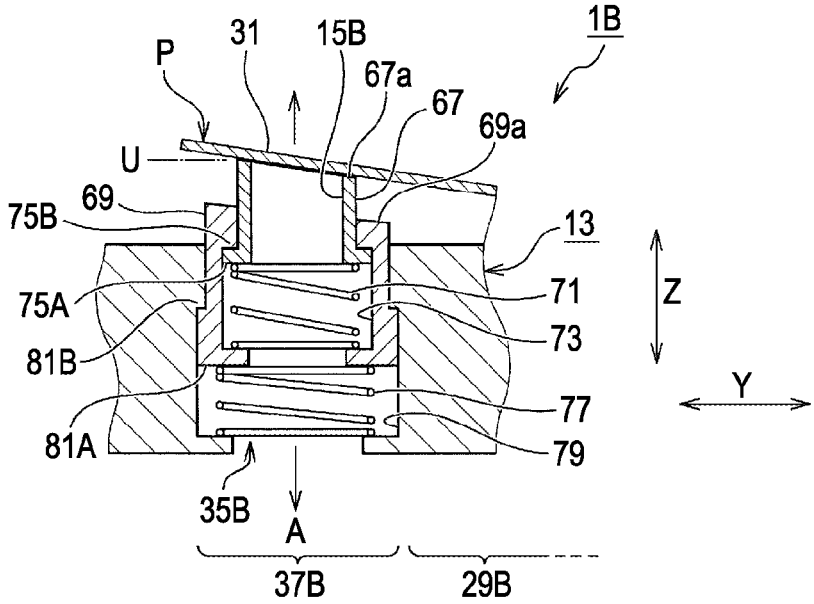
FIG. 6A is an enlarged sectional view when the movable suction section according to a third embodiment of the invention is positioned in an upper position.
Figure 6B:
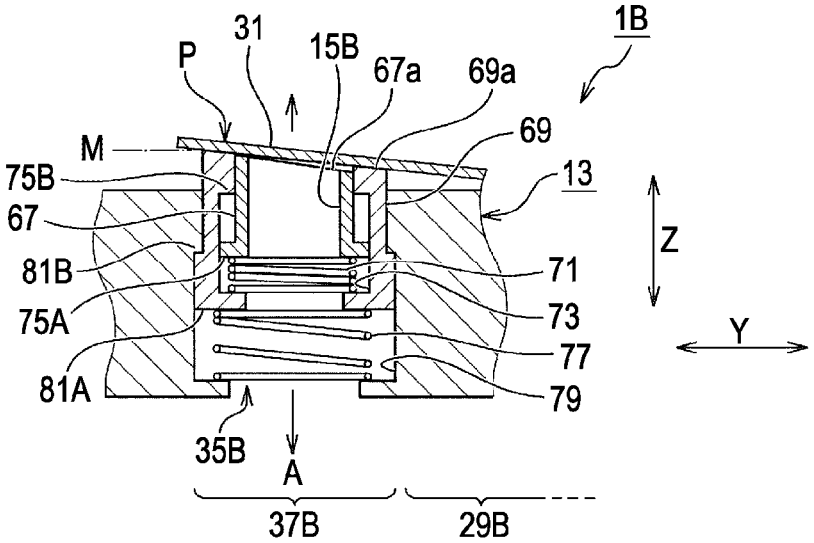
FIG. 6B is an enlarged sectional view when positioned in an intermediate position.
Figure 6C:
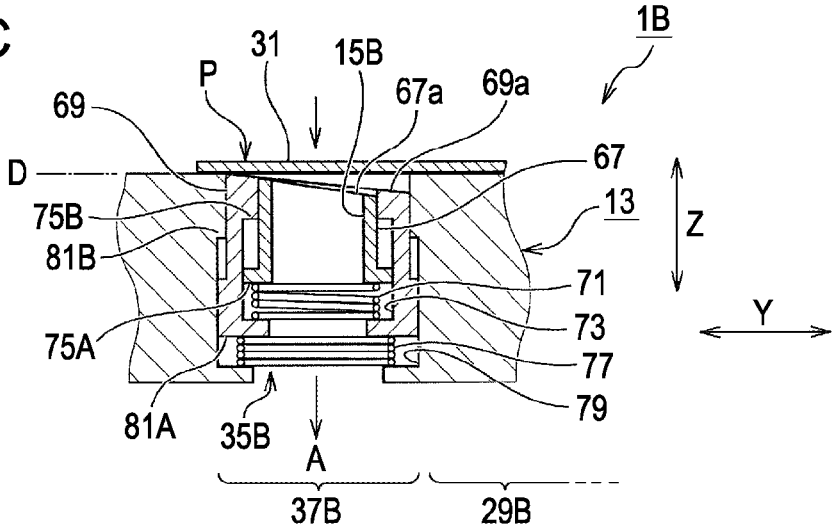
FIG. 6C is an enlarged section view when positioned in a lower position.

FIGS. 6A to 6C disclose the structure of the peripheral section of the movable platen section 37 of an ink jet printer 1B which is a recording apparatus according to a third embodiment. The basic configuration of the ink jet printer 1B is the same as that of the ink jet printer 1A according to the second embodiment and therefore only differences from the second embodiment will be described.

In this embodiment, the movable suction section 35B has a double pipe structure formed of an inner pipe 67 and an outer pipe 69. A pair of detachment prevention portions 75A, 75B and a first spring space 73 that contains a first compressed coil spring 71 as a resilient member 57 are provided between the inner pipe 67 and the outer pipe 69. A pair of detachment prevention portions 81A, 81B and a second spring space 79 which contains a second compressed coil spring 77 as the resilient member 57 are formed between the outer pipe 69 and the fixed platen section 27.

The angle of inclination of the upper end face 67*a* of the inner pipe 67 is set as an angle of inclination along the curling shape of the recording material P, and the angle of inclination of the upper end face 69*a* of the outer pipe 69 is set to an intermediate inclination angle with respect to the horizontal plane which is smaller than the angle of inclination of the upper end face 67*a* of the inner pipe 67.

When adopting the ink jet printer 1B having this configuration, an effect is obtained which is the same as the second embodiment. Furthermore a two-stage position is adopted including an upper position U shown in FIG. 6A at which the movable suction section 35B undergoes maximum extension with respect to the curling shape of the recording material P and an intermediate position M as shown in FIG. 6B at which the inner pipe 67 of the movable suction section 35B is contained in the outer pipe 69. Consequently warpage correction in the recording material P is further ensured due to the increase in the suction force of the movable suction section 35B in comparison with the second embodiment.

Embodiment 4

Figure 7A:
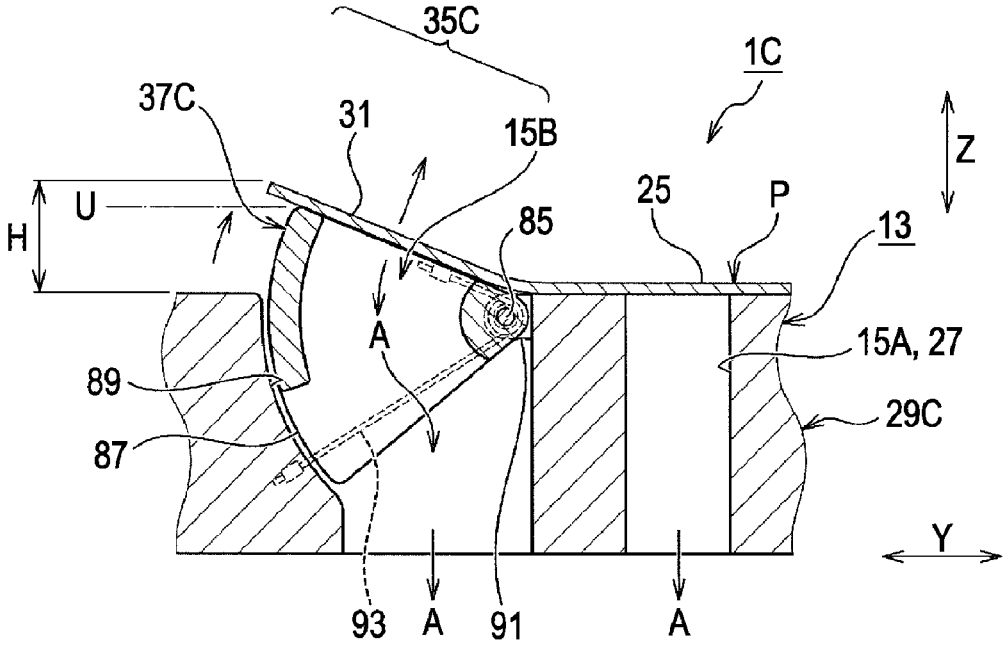
FIG. 7A is an enlarged sectional view when the movable suction section according to a fourth embodiment of the invention is positioned in an upper position.
Figure 7B:
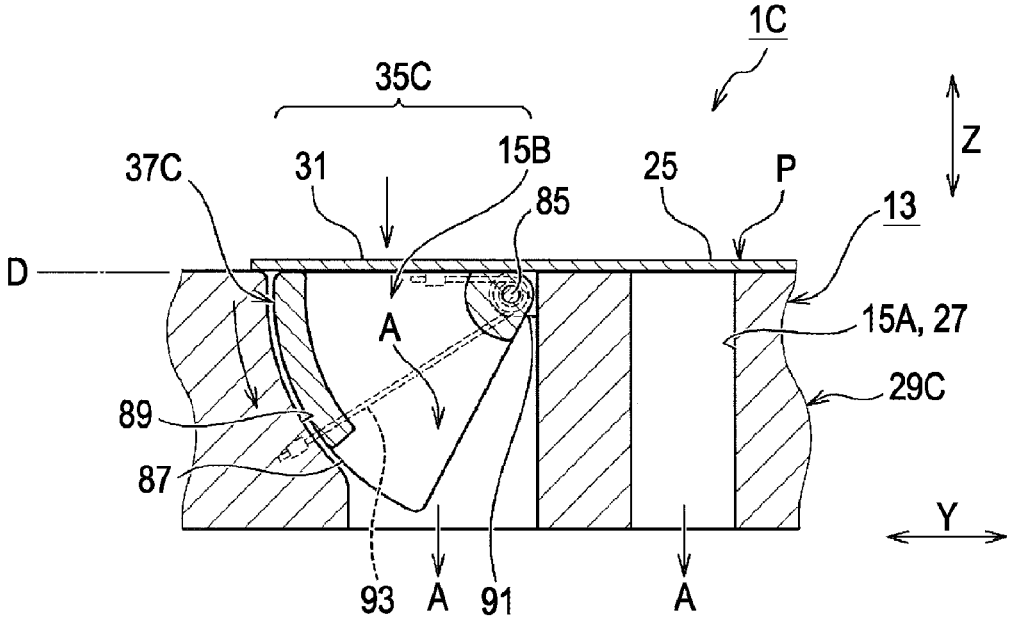
FIG. 7B is an enlarged sectional view when positioned in a lower position.

FIGS. 7A and 7B show the structure of the periphery of the movable platen section 37 of an ink jet printer 1C which is a recording apparatus according to a fourth embodiment. The basic configuration of the ink jet printer 1C is the same as that of the ink jet printer 1A according to the second embodiment and therefore only differences from the second embodiment will be described.

In this embodiment, the movable suction section 35C does not slide linearly in a vertical direction Z but displaces vertically while rotating about a rotation point 85. In other words, the sectional shape of the movable suction section 35C as shown in FIGS. 7A and 7B may be in the form of a cylindrical shape bent into a fan. A sliding face 89 formed into an arcuate face to slide on the outer peripheral face 87 of the movable suction section 35C and a rotation support section 91 that supports the rotation point 85 are provided on the fixed platen section 29 mounting the movable suction section 35C. Furthermore in this embodiment, a torsion coil spring having a resilient force which is equal to that of the compression coil spring 59 of the second embodiment is used as a resilient member 57.

When adopting the ink jet printer 1C having this configuration, an effect is obtained which is the same as the second embodiment. Furthermore since the angle of inclination of the suction face 45C of the movable suction section 35C varies continuously, warpage correction in the recording material P is improved and smoothly executed due to the further increase in the suction force on the recording material P of the movable suction section 35C.

Embodiment 5

Figure 8A:
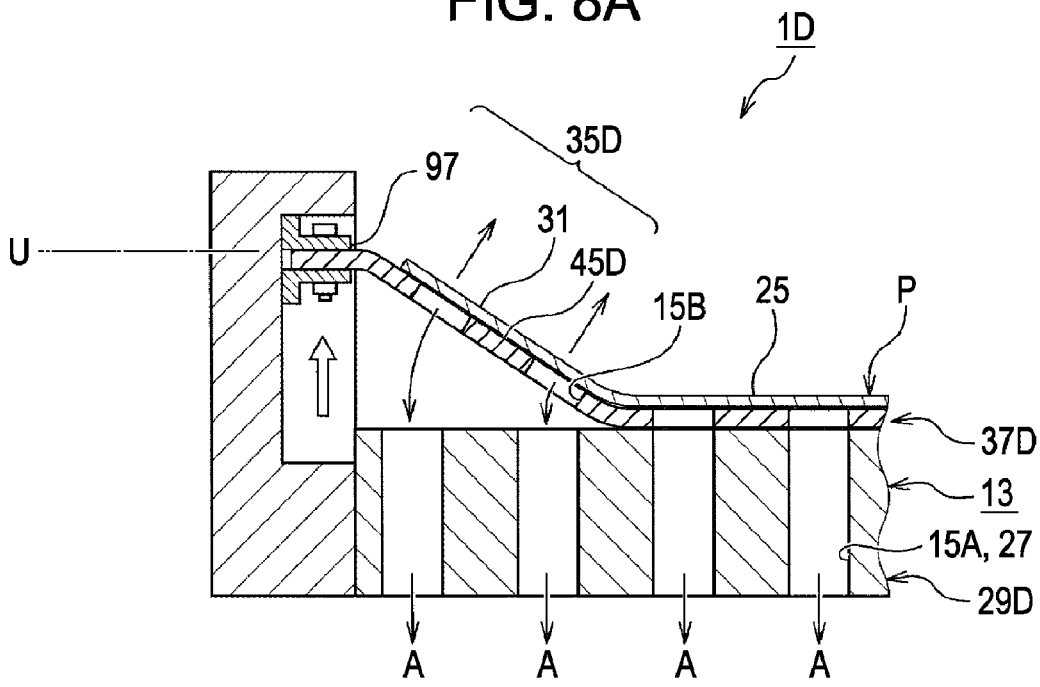
FIG. 8A is an enlarged sectional view when the movable suction section according to a fifth embodiment of the invention is positioned in an upper position.
Figure 8B:
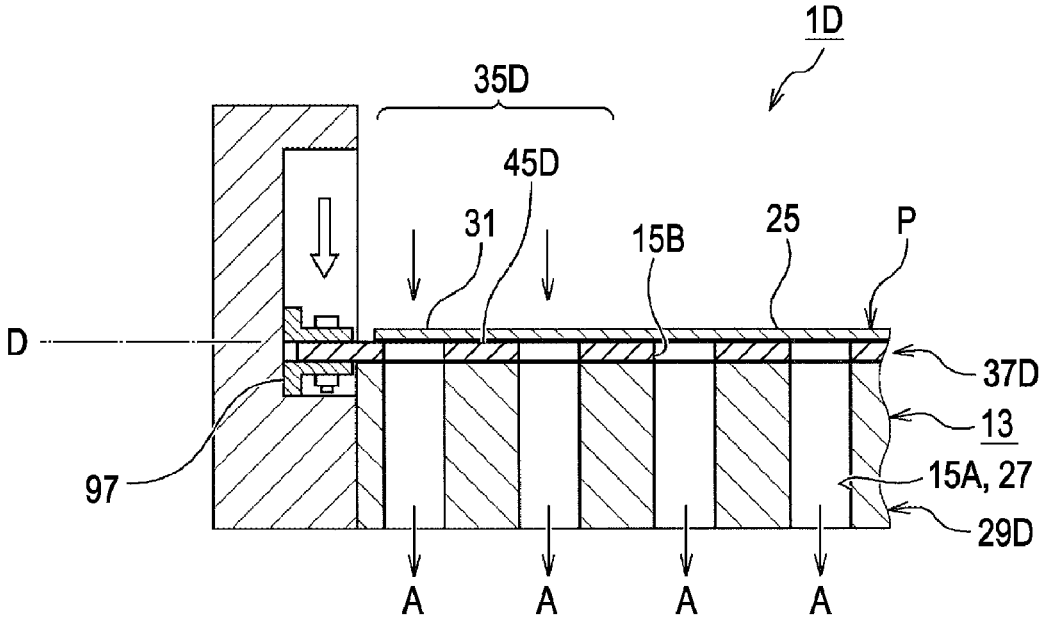
FIG. 8B is an enlarged sectional view when positioned in a lower position.

FIGS. 8A and 8B show the structure in the periphery of the movable platen section 37D of the ink jet printer 1D which is a recording apparatus according to a fifth embodiment. The basic configuration of the ink jet printer 1D is the same as that of the ink jet printer 1 according to the first embodiment and therefore only differences from the first embodiment will be described.

This embodiment differs from the above embodiments in that a structure is adopted in which a movable platen section 37D formed using a sheet-shaped or a slightly thickened flexible plastic material is laminated on an upper surface of the fixed platen section 29D. Suction holes 15A and suction holes 15B which respectively face each other are provided in the fixed platen section 29D and the movable platen section 37D.

Both right and left end sections of the movable platen section 37D are retained by a clamp 97 and the clamp 97 is adapted to be displaced vertically with a predetermined stroke by the driving mechanism 39. Both right and left end sections of the movable platen section 37D including the section retained by the clamp 97 form movable suction sections 35D. The inclination angle of the suction face 45D of the movable suction section 35D can be varied continuously between an upper position U shown by FIG. 8A and a lower position D shown by FIG. 8B by displacing the movable suction section 35D in a vertical direction Z by the vertical motion of the clamp 97.

When adopting the ink jet printer 1D having this configuration, an effect is obtained which is the same as the first embodiment. Furthermore since the angle of inclination of the suction face 45D of the movable suction section 35D varies continuously, warpage correction in the recording material P is improved and smoothly executed due to the further increase in the suction force on the recording material P of the movable suction section 35D.

Further Embodiment

Although the recording apparatus according to this invention has the basic configuration described above, naturally partial modification or omission of the configuration is possible without departing from the spirit of the invention.

For example, when the movable suction section 35 is provided at a plurality of positions corresponding to the dimensions of the recording material P assumed to be used, the movable suction section 35 can be displaced vertically to an optimal position by detection of the motion of an edge guide or by coordinating motion with the motion of an edge guide (not shown) provided on a feed unit or the like.

The resilient member 57 of the second embodiment to the fourth embodiment is not limited to a compressed coil spring or a torsion coil spring and may be another spring member such as a plate spring. Use of an elastic rubber member or air damper is also possible.

In addition, the platen 13 which has various structures and is the characteristic element of the embodiments may be applied to a line printer in which the recording head 9 does not displace but rather is retained in a fixed state by a retaining member, or to an ink jet printer in which a carriage scans in a direction which intersects with the transportation direction X.

The number, the configuration or the shape of the movable suction sections 35 may be adapted or changed in response to differences, for example, in the format (centrally or laterally aligning) of the edge guide or the dimensions of the recording material P which is used.

As described above, the invention is provided with a recording head 9 that executes recording by ejecting ink onto a recording surface of a recording material P, a platen 13 that supports a face opposite the recording surface of the recording material P positioned on a recording execution region by the recording head 9, and a plurality of suction hole sections 15A, 15B on the platen 13. The platen 13 is configured so that movable suction sections 35R, 35L which have the suction hole sections 15A, 15B and form side edge sections in the width direction are retractable with respect to the recording head 9. The movable suction sections 35R, 35L are advanced towards the recording head 9 and are retracted after attaching right and left side edge sections 31R, 31L of the curling recording material P. After retraction, recording on the recording material P is executed by the recording head 9. In this manner, high-quality recording can be executed without adverse effects due to curling as a result of correcting curl in the recording material P and placing the material in a flat orientation.

What is claimed is:

1. A recording apparatus comprising:

a recording head that executes recording by ejecting ink onto a recording surface of a recording material;

a platen that supports a face opposite the recording surface of the recording material positioned on a recording execution region by the recording head; and a plurality of suction hole sections provided in the platen, wherein:

the platen is configured so that both side edge sections in a width direction provided with the suction hole sections are retractable with respect to the recording head, and both side edge sections of the platen are advanced towards the recording head and are retracted after attaching by suction of a curling section of the right and left side edges of the recording material and then after retraction, recording is executed on the recording material by the recording head.

2. The recording apparatus according to claim 1, wherein:

both side edge sections are integrated with the plurality of suction hole sections as a unit and are formed as a movable unit.

3. The recording apparatus according to claim 1, wherein:

the suction hole sections of both retractable side edge sections include a suction face facing the recording material that is configured as an inclining surface along the curling shape of the recording material.

* * * * *